United States Patent [19]

Maassen et al.

[11] 4,164,330

[45] Aug. 14, 1979

[54] DEVICE FOR TRANSFERRING A THREAD TO AN UNWOUND COIL CORE

[75] Inventors: Wilhelm Maassen; Hans Raasch; Heinz-Georg Wassenhoven, all of Mönchengladbach, Fed. Rep. of Germany

[73] Assignee: W. Schlafhorst & Co., Mönchengladbach, Fed. Rep. of Germany

[21] Appl. No.: 862,492

[22] Filed: Dec. 20, 1977

[30] Foreign Application Priority Data

Dec. 21, 1976 [DE] Fed. Rep. of Germany ..... 2657798

[51] Int. Cl.[2] ..... B65H 54/02; B65H 65/00

[52] U.S. Cl. ..... 242/18 PW; 57/279; 242/19; 242/35.5 A

[58] Field of Search ..... 242/18 PW, 18 DD, 18 R, 242/19, 35.5 A, 41

[56] References Cited

U.S. PATENT DOCUMENTS

| | | | |
|---|---|---|---|
| 3,791,126 | 2/1974 | Kose et al. | 242/35.5 A X |
| 3,801,030 | 4/1974 | Kobatake et al. | 242/19 X |
| 3,899,140 | 8/1975 | Gleyze | 242/18 PW |
| 3,908,918 | 9/1975 | Bergstrom | 242/18 PW X |
| 3,915,398 | 10/1975 | Corl | 242/19 X |
| 3,948,452 | 4/1976 | Burysek et al. | 242/18 PW X |
| 3,974,972 | 8/1976 | Egli et al. | 242/18 PW |
| 4,023,741 | 5/1977 | Schar | 242/18 PW X |
| 4,052,017 | 10/1977 | Schar | 242/18 DD X |
| 4,069,983 | 1/1978 | Muramatsu et al. | 242/18 PW |

*Primary Examiner*—Stanley N. Gilreath
*Attorney, Agent, or Firm*—Herbert L. Lerner

[57] ABSTRACT

Device for transferring to an empty coil core a thread continuously fed to the take-up coil of a rotor spinning machine, includes a thread guide traversible along a reciprocating path between the ends of a coil core for guiding a thread onto the coil core, a thread pickup assembly having means for picking up the thread under tension before transfer thereof to an empty coil core, the thread pickup assembly being pivotable from a location on the reciprocating path to one of the ends of the coil core, the thread pickup assembly includes a thread capturing device as well as a pair of thread severing devices respectively disposed in front of and behind the pickup means in travel direction of the thread, the thread severing devices being activatable in time sequence by movement of the thread pickup so that the thread severing device disposed behind the pickup means is activatable, after capture of the thread by the capturing device, in time coordination with the pickup of the thread, and the thread severing device disposed in front of the pickup means is activatable at an instant within the period during and shortly after transfer of the thread to the empty coil core.

7 Claims, 7 Drawing Figures

DEVICE FOR TRANSFERRING A THREAD TO AN UNWOUND COIL CORE

The invention relates to a device for tranferring to an empty or unwound coil core a thread which is fed continuously to the takeup coil of a rotor spinning machine.

Heretofore, the spinning station of a rotor machine would be taken out of operation or service when a take-up coil was being changed. This resulted in disadvantages due to thread number variations, time consumed and special make-ready operations on the coil that was to be newly wound.

It has also been proposed heretofore to effect an automatic or semi-automatic exchange of coils by means of complex control devices.

It is an object of the invention to provide a device for transferring a thread to an empty coil core wherein the exchange of take-up coils is accelerated by relatively simple means, is made operationally reliable and avoids taking the rotor spinning machine out of operation.

With the foregoing and other objects in view, there is provided, in accordance with the invention, a device for transferring to an empty coil core a thread continuously fed to the take-up coil of a rotor spinning machine, includes a thread guide traversible along a reciprocating path between the ends of a coil core for guiding a thread onto the coil core, a thread pickup assembly having means for picking up the thread under tension before transfer thereof to an empty coil core, the thread pickup assembly being pivotable from a location on the reciprocating path to one of the ends of the coil core, the thread pickup assembly includes a thread capturing device as well as a pair of thread severing devices respectively disposed in front of and behind the pick-up means in travel direction of the thread, the thread severing devices being activatable in time sequence by movement of the thread pickup so that the thread severing device disposed behind the pickup means is activatable, after capture of the thread by the capturing device, in time coordination with the pickup of the thread, and the thread severing device disposed in front of the pickup means is activatable at an instant within the period during and shortly after transfer of the thread to the empty coil core.

The time coordination between severing the thread and picking up the thread is maintained if the thread is severed shortly before, during or shortly after the pickup.

The thread severing devices are formed advantageously of stationary, uncontrolled knives, with which thread guidance contours are associated. These thread guidance contours deflect the thread from the travel direction thereof, as a result of which the thread tension can increase, and the thread guidance contours then lead the thread in the course of the movement of the thread pickup over the knife edge, where it is severed due to the thread tension.

In accordance with another feature of the invention, the thread severing devices are formed of stationary, uncontrolled knives having thread guidance contours associated therewith, and the thread pickup means comprise a suction tube formed with a thread suction opening.

In accordance with a further feature of the invention, the device includes a separate thread guide disposed on the thread pickup assembly so as to guide the thread automatically into vicinity of the coil core during a pivoting movement of the thread pickup assembly.

In accordance with an added feature of the invention, for forming a thread reserve on the coil core, the separate thread guide is disposed so that it is located outside the traversible reciprocating path of a takeup coil, that is to be newly wound, the instant the thread pickup has completed the pivoting movement thereof in direction toward one of the ends of the coil core.

In accordance with an additional feature of the invention, the device includes a thread monitor activatable in response to absence of the thread for effecting shutdown of the machine, and means connected to the thread pickup for temporarily inactivating the thread monitor.

In accordance with yet another feature of the invention, the device includes a thread monitor activatable in response to absence of the thread for effecting shutdown of the machine, and a device responsive to the fullness of winding on the takeup coil for automatically delivering the thread pickup means into vicinity of the traversible reciprocating path of the thread fed to the takeup coil and for temporarily inactivating the thread monitor.

In accordance with a concomitant feature of the invention, the device responsive to the fullness of winding on the takeup coil has an electromagnetic drive operatively connected to the thread pickup means and to the thread monitor, the electromagnetic drive having a winding, and including switch means responsive to fullness of winding on the takeup coil, the switch means connecting the winding of electromagnetic drive to a voltage source.

A suction tube supplying underpressure or negative pressure is an especially simple device and is therefore particularly well suited for solving the problem of the invention. However, it is also conceivable to pick up the thread by mechanical means rather than by such pneumatic means.

The separate thread guide of the invention comes into contact with the thread in the course of the pivoting movement of the thread pickup means, deflects the thread from the travel direction thereof and brings the section of the thread disposed between the thread guide and the thread pickup means closer to the coil core than would be possible without a separate thread guide.

The thread capturing device, the thread severing devices and the separate thread guide are advantageously connected to the thread pickup means in fixed or adjustable relationship and form a unitary structure therewith. If the thread pickup means constructed in accordance with the invention is moved into the range of traverse of the thread guide, the running thread is initially captured by the thread capturing service, is deflected from the direction of traverse thereof and is severed by the rear thread severing device. This produces an upper thread, which runs onto the takeup coil, and a lower thread which is picked up during the severing operation, or shortly before or after the severing operation by the thread pickup means and held under tension. Thereafter, the fully wound takeup coil can be exchanged for an unwound or empty coil core. If, then, the thread pickup means is swung to one end of the coil core, the thread arrives within the range of the rotating coil core or of a thread catcher which rotates together with the coil core and grips and holds the thread fast. At this instant, the front thread severing device is activated, and the connection of the thread pickup means with the coil core is interrupted by this thread severing device, while the continuously fed thread is then wound on the coil core. The control of these individually sequential processes can be accomplished by the motion of the thread pickup means alone without separate control means.

If a thread reserve is initially wound onto the empty coil core after transfer of the thread to the coil core, using the device according to the invention, then the turns of the thread reserve are advantageously wound over the thread starting end, which is thereby secured.

For transferring the thread to the thread guide of the spinning station, a thread ejector is advantageously associated with the separate thread guide. This thread ejector can be operated manually or also automatically.

In those cases wherein a thread reserve is formed at the start of the winding besides the winding per se, the thread comes within the range of traverse of the takeup coil only if the thread is removed from the separate thread guide, for example, by actuating the thread ejector. In other cases, the separate thread guide is constructed so that the thread leaves this thread guide automatically after the transfer.

It may be advantageous to monitor the spun thread above the thread withdrawal device by a thread guard or monitor. During coil exchange, the thread tension can briefly drop so low in this case, at the instant the thread is severed, that the thread monitor responds and issues a signal for stopping the spinning station. It is therefore advantageous to inactivate or render the thread monitor ineffective temporarily during the coil exchange. Since the invention need not be fixedly installed at each spinning station, but must only be present at the respective spinning station during the coil exchange, it is proposed, in accordance with the invention, to connect to the thread pickup means a device for temporarily inactivating or rendering the thread monitor ineffective. If the thread pickup means is then taken out of operation again after the coil exchange is completed, the thread monitor must forcibly become effective again. This device for temporarily inactivating or rendering the thread monitor ineffective is formed, advantageously, of a magnet. Such a magnet is capable of acting on mechanical, magnetic or electrical parts of the thread monitor. One possible mechanical effect of the magnet on the thread monitor is that the magnet limits mechanical movement of the thread monitor or the sensing member thereof.

Since on the one hand, the takeup coils of the spinning machine need not all be exchanged simultaneously and, on the other hand, the coils need not always be exchanged immediately after a desired fullness of winding thereof has been attained, it is proposed, in accordance with the invention, that the suction tube serving as the thread pickup means be connected sequentially, at several spinning stations, to an underpressure or negative-pressure connection or union associated with each spinning station. Thus, the suction tube can be brought from one spinning station to another either manually or automatically and be set in operation there as desired. The underpressure or negative-pressure connection is advantageously constructed as a plug-in coupler that is automatically closable, as desired. In this case, a single underpressure or suction generator is sufficient for the entire spinning machine. The sucked-in thread ends can then be collected simultaneously at a central location.

The invention also provides the advantage of producing take-up coils of equal fullness of winding and equal coil diameter or equal thread length without requiring the spinning station to be taken out of operation or service when the desired fullness of winding of the respective coils is attained.

Upon reaching the desired fullness of winding of the respective coil, a device according to the invention is activated which immediately brings the suction tube into the range of traverse, severs the thread to the take-up coil immediately, inactivates or renders the thread monitor ineffective, and picks up the thread which is continuously supplied by the spinning station. The switch, which is responsive to the fullness of winding of the coil can set a signal and/or summon a coil exchanging device. The coil exchange can also be effective manually, however.

As has been explained hereinafter, the invention affords the exchange of take-up coils without interruption of the spinning process of the rotor spinning machine.

If the coils are manually exchanged, the invention provides the particular advantage that even unskilled operators can effect a trouble-free coil exchange without loss of time. If the coils are exchanged mechanically by a coil exchanging device, the invention offers the advantage of simplicity.

Other features which are considered as characteristic for the invention are set forth in the appended claims.

Although the invention is illustrated and described herein as embodied in a device for transferring a thread to an unwound coil core, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
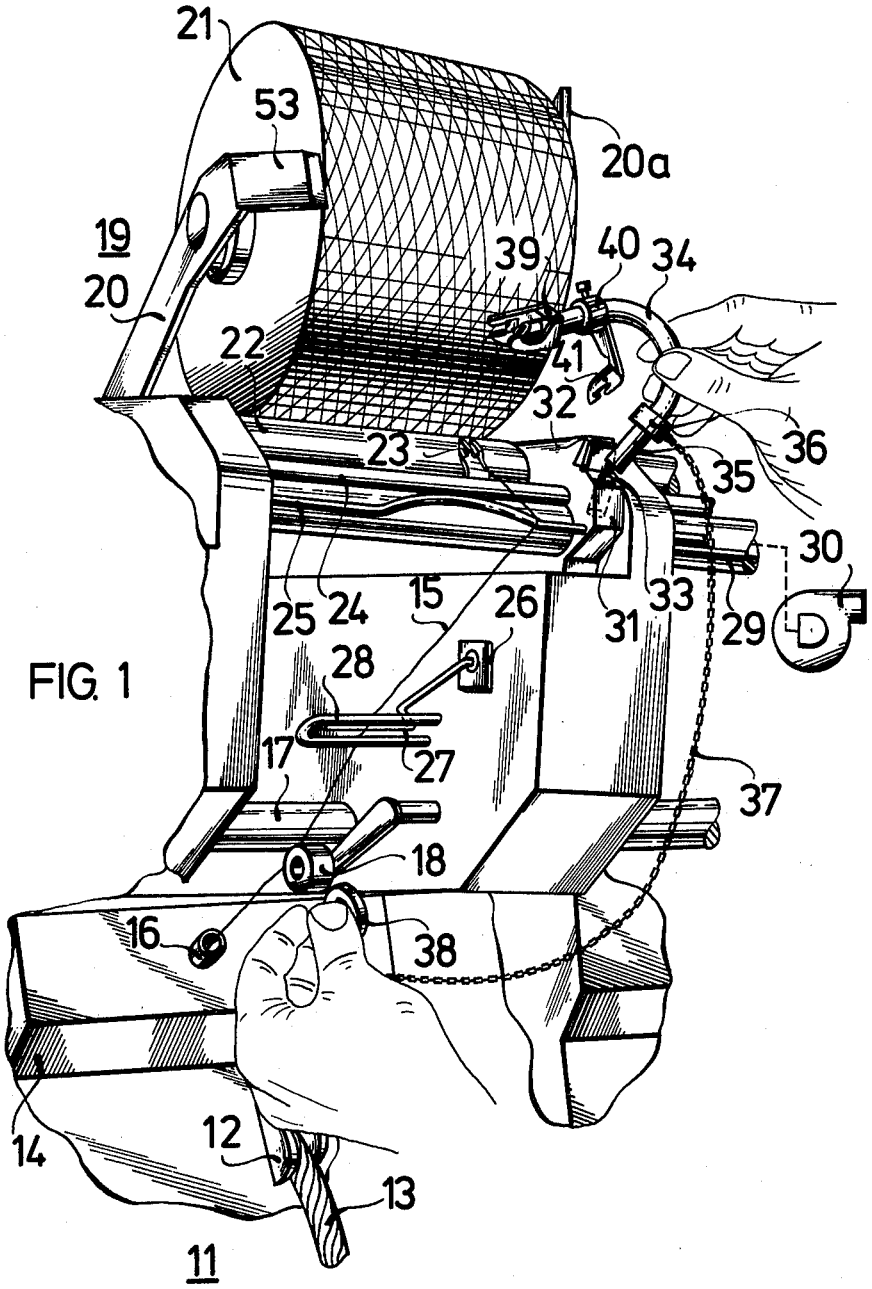
FIG. 1 is a front elevational view of a first embodiment of the device for transferring a thread to an unwound coil core according to the invention.

Referring now to the drawing and first, particularly, to FIG. 1 thereof, there is shown an individual spinning station 11 of a rotor spinning machine. The spinning station 11 is formed of a sliver inlet 12 for a sliver 13, and a covered spinning device 14 from which spun thread 15 is withdrawn at constant speed through a withdrawing tube 16 by a withdrawing device 17, 18. In the upper part of the spinning station 11, as shown in FIG. 1, there is provided a winding device 19 with a coil frame 20, 20a and a take-up coil 21 fastened therein. The winding device 19 also includes a winding roller 22 which rotates continuously and by which the take-up coil 21 is set in rotation by friction. In front of the winding cylinder 22, a thread guide 23 is provided, which is fastened to a push rod 24. The push rod 24 is reciprocated in longitudinal direction thereof, so that a range of traverse is produced for the thread 15 that corresponds, in fact, to the width of the take-up coil 21 at the point of contact of the take-up coil 21 with the winding cylinder 22. The thread 15 is fed to the thread guide 23 over an equalizing wire 25, the shape of which ensures uniform thread tension when the take-up coil 21, which is in the form of a cross-wound coil, is wound.

Above the withdrawing device 17, 18, there is provided a thread monitor 26 having a follower bar 27 which engages the thread 15 stressed in tension and, in the event an undue reduction in the thread tension occurs, swings downwardly between the legs of a steel U-shaped bracket 28, the thread monitor 26 then issuing a stop signal for the spinning station.

In FIG. 1, there is also seen an underpressure or negative-pressure line 29 which extends along the entire spinning machine and is connected to an underpressure or suction generator 30, which is shown only symbolically.

The spinning station 11 has an underpressure or negative-pressure connection point 31 which is constructed as a plug-in coupler which is automatically closable by a cover 32. At the plug-in coupler 31, there is provided a bore 33 which extends into the interior of the underpressure or negative-pressure line 29.

A bent suction tube 34, which an operator carries with him and which serves as the thread pickup, is, in fact, being held with the plug-in base 35 thereof over the underpressure or negative-pressure connection point 31 by the hands of an operator, in the view of FIG. 1. The cover 32 is already swung open. It is apparent in FIG. 1 that a chain 37 leads from a collar 36 of the suction tube 35 to a magnet 38, which the operator is holding in his left hand. At the suction tube 34, there is further seen a head 39 and another collar 40 with a separate thread guide 41.

Figure 2:
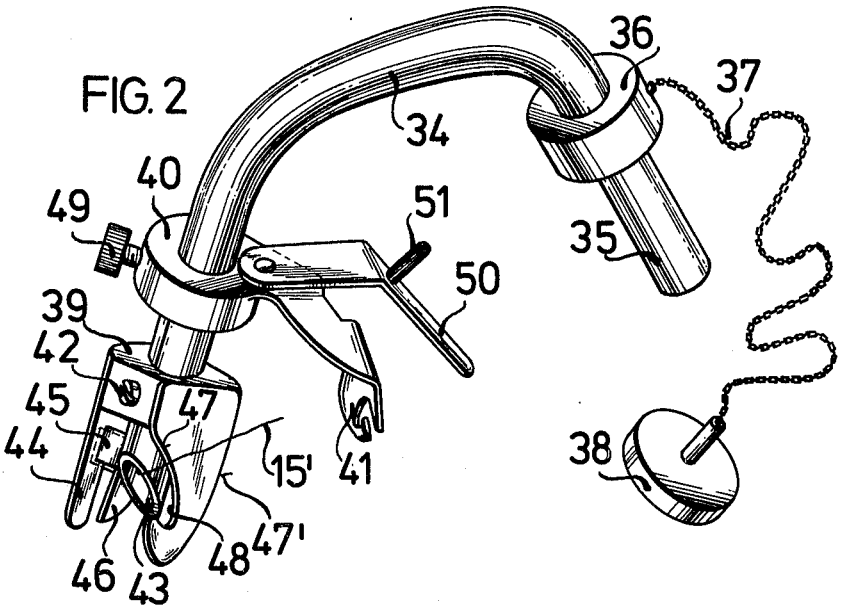
FIG. 2 is a view of the suction tube forming part of the device of FIG. 1 but enlarged thereof to substantially the actual size thereof.

In FIG. 2, the suction tube 34 is shown substantially actual size. The head 39 is fastened by a screw 42 to the upper end of the suction tube 34. The suction tube ends at a thread suction opening 43. At the head 39, there is provided a thread capturing device 44 in the form of a hook, a read thread-severing device in the form of a knife 45 and a thread guiding contour member 46 which is associated with the knife 45 and is shaped as a plate with a curved and rounded lower edge. The thread capturing device 44, the knife 45 and the thread guiding device 46 are united into one structural unit. At the front of the head 39 there are provided additional thread guiding contours 47 and 47' which are likewise united together with a front thread severing device formed as a knife 48 into one structrual entity. These thread guiding contours are formed by a plate with rounded edges.

The separate thread guide 41 is adjustable by means of a set screw 49 provided at the collar 40. In the embodiment according to FIG. 2, a thread ejector 50 is articulatingly connected to the separate thread guide 41. The thread ejector 50 is actuatable by a lever 51. The plug-in base 35 of the suction tube 34 fits with slight play into the bore 33 of the underpressure or negative-pressure connection location 31 and therefore serves to guide the suction tube 34 when it is introduced into the range of traverse of the thread guide 23 and of the thread 15 fed to the take-up coil 21.

Figure 3:
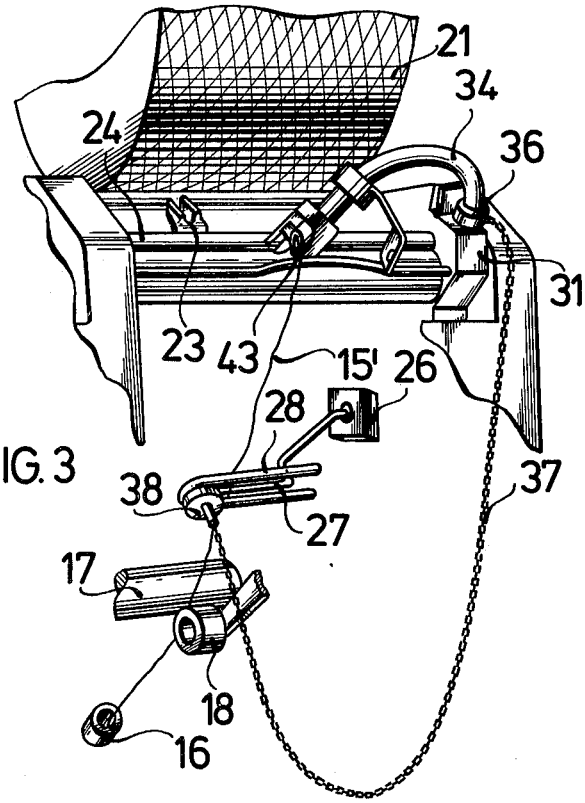
FIG. 3 is a fragmentary view of FIG. 1 showing the device in an operating mode thereof after the thread has been severed.

To make ready for the coil exchange, the operator, with his left hand, places the magnet 38 from below against the U-shaped bracket 28. Thereby, the follower 27 is prevented from swinging downwardly through the legs of the U-shaped bracket 28. The thread monitor 26 can therefore no longer respond or signal. Then, the plug-in base 35 is inserted with the right hand by the operator into the bore 33. The head 39 of the suction tube 34 points to the left hand side, as viewed in FIG. 1, for example, approximately in the direction of the underpressure of negative-pressure line 29 and comes within the range of traverse of the thread 15. The instant the plug-in base 35 is inserted into the bore 33 up to the collar 36 serving as a stop, as shown in FIG. 3, for example, the head 39 is within the range of traverse of the thread 15. The thread guidance contour 46 is disposed in a manner that during a traverse movement, the thread can slide off from the right-hand to the left-hand side. During the immediately subsequent traversing movement from the left-hand to the right-hand side, however, the thread slips into the slot of the thread capturing device 44. Before the thread can again perform its traversing movement in the opposite direction, the travel direction thereof is changed, since before traversing movement is resumed, the thread tension increases and the thread is severed by the knife 45, so that an upper thread and a lower thread are formed. The upper thread is wound on the take-up coil 21. The lower thread, on the other hand, is sucked into the thread suction opening 43 immediately after the severing operation is performed, while the thread withdrawal from the spinning device 14 continues uninterruptedly and at undiminished velocity. This phase or condition is shown in FIG. 3. The lower thread or the sucked-up thread 15' is then kept under tension by the under-pressure or negative-pressure and runs continuously into the thread suction opening 43 without touching the knife 48 of the forward thread severing device, as is shown especially also in FIG. 2. The fully wound take-up coil 21 can then be removed and a new, unwound coil core 52 (FIG. 4) installed in place thereof. To this end, the coil frame 20 is swung sideways to the left-hand side of FIG. 4, for example, by means of a handle 53, whereby the core holders 54 and 55, shown in FIGS. 5 and 6, are released from the core of the take-up coil 21.

Figure 4:
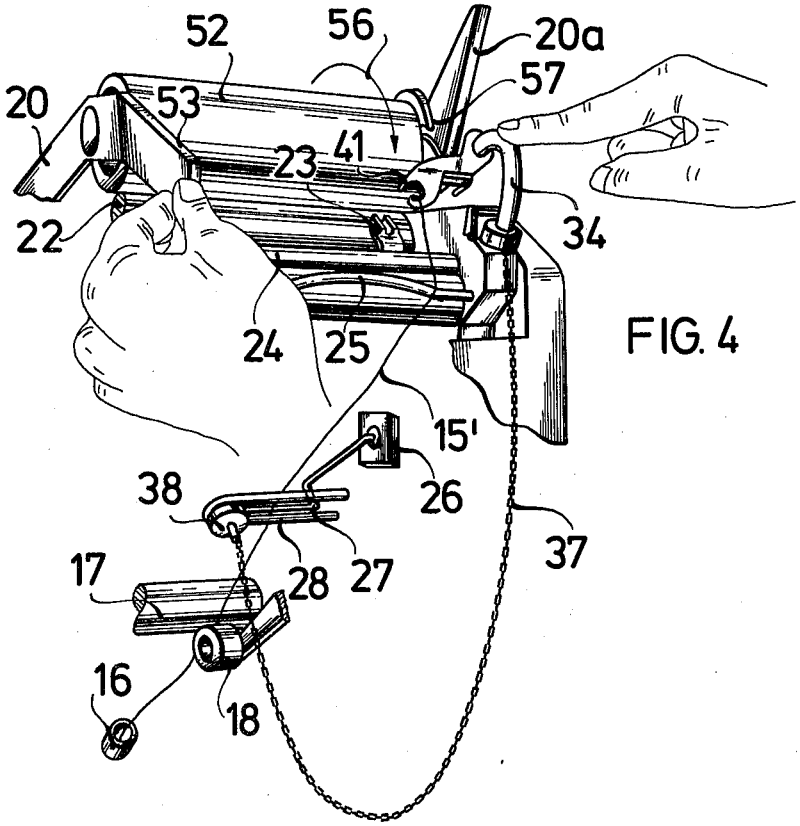
FIG. 4 is a view similar to that of FIG. 3 showing the device in yet another mode of operation thereof wherein the thread is being transferred to the new unwound or empty coil core.

After a new coil core has been inserted into the coil frame 20, 20a, the winding of a new take-up coil begins in the following manner:

The suction tube 34 is swung by the operator's right hand into the bore 333 about 100° to the right-hand side, as shown in FIG. 4. While the suction tube 34 is being swung, the sucked-in thread 15' automatically slips into the separate thread guide 41 and is guided by the thread guidance contour 47 into the thread suction opening 43 without touching the knife 48. Then, the operator grips the handle 53 with his left hand, and moves the coil frame 20, 20a downwardly until the coil core 52 engages the winding cylinder 22. At that instant, the coil core 52 begins to rotate in direction of the arrow 56 and, with it, a catching or capturing hook 57 at the core holder 55.

Figure 5:
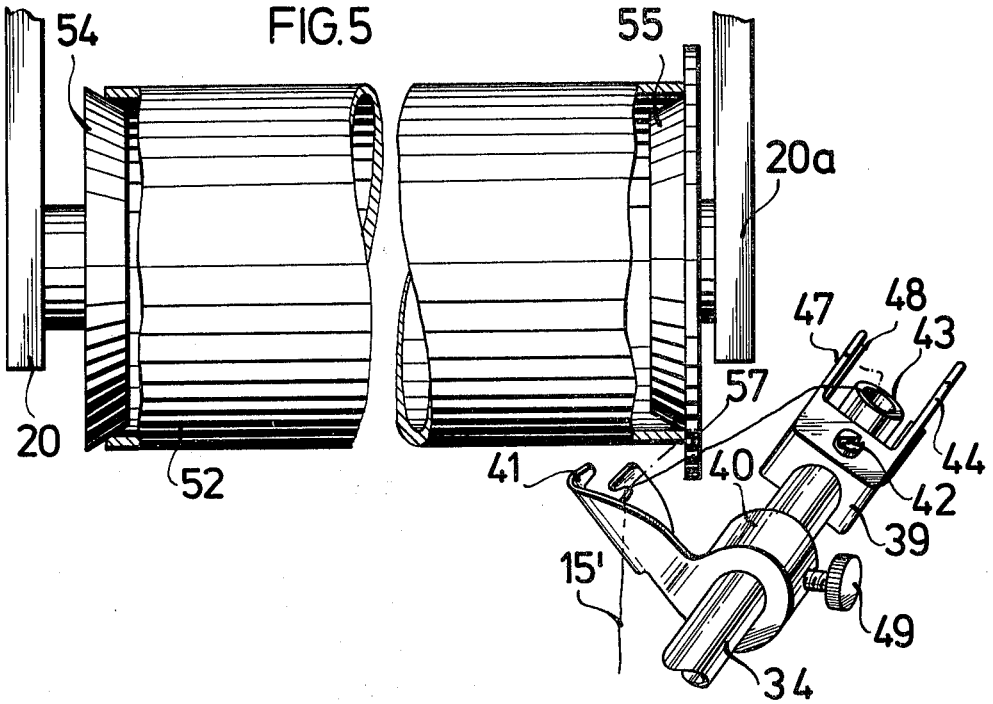
FIG. 5 is a fragmentary top plan view of the device in an operating mode thereof wherein the thread is seized for forming a thread reserve.
Figure 6:
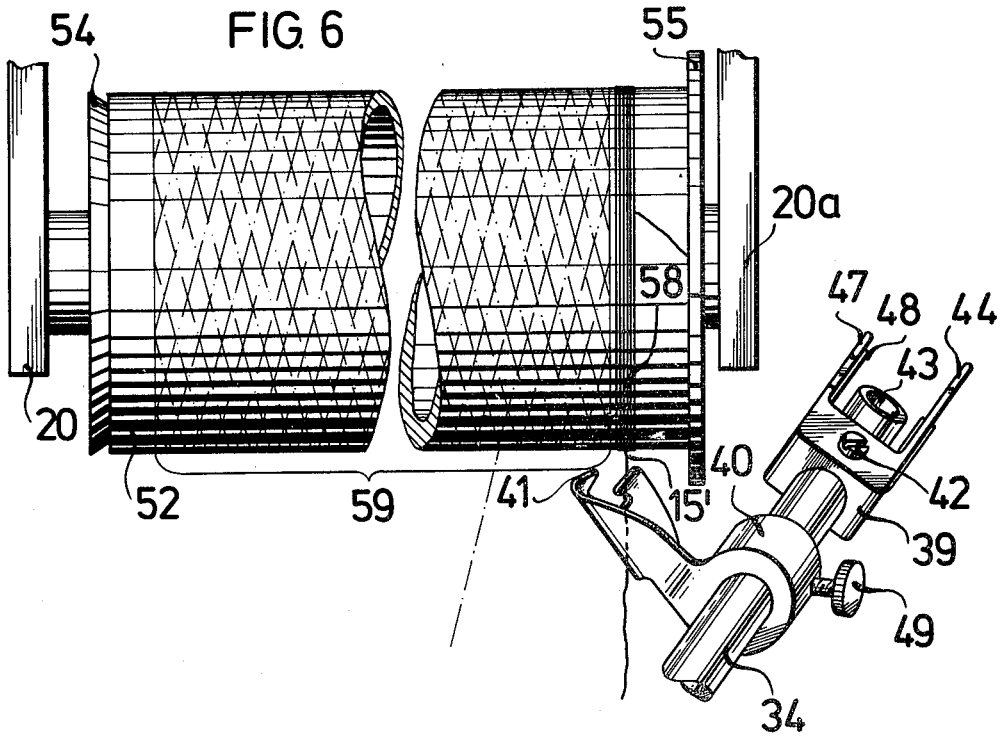
FIG. 6 is a view similar to that of FIG. 5 showing the device in an operating mode wherein the new coil is to be wound, after the thread reserve has been formed.

FIG. 5 shows the device of the invention in a plan view at the instant when the catching hook 57 just seizes the sucked-in thread 15' in the section between the separate thread guide 41 and the thread suction opening 43. Upon further rotation of the coil core 52 and the catching hook 57, the thread is drawn into the position thereof shown in phantom and is clamped between the coil core 52 and the core holder 55. In the course thereof, the thread slides from the separate thread guiding contour 47 over the knife 48. The sucked-in thread end is thereby severed. The separate thread guide 41 then assumes further guidance of the thread, as is shown in FIG. 6. According to FIG. 6, the thread has already been wound on the core 52 to form a thread reserve 58. As soon as the thread reserve has been completed with the desired number of turns, the thread 15' can be ejected from the separate thread guide 41 by hand or by swinging the thread ejector 50, which is articulatingly connected to the separate thread guide 41, by pushing the lever 51 so the ejector 50 pushes the thread. This is shown only in FIG. 2, however, and during the process, the thread 15' is gripped automatically and forcibly by the reciprocating thread guide 23 of the spinning station and is wound into a new take-up coil over a width corresponding to the range 59 of traverse. The position of the starting turns of the new coil to be wound is shown in FIG. 6 by dot-dash line.

The coil exchange has then been completed, and the suction tube 34 is thereafter drawn out of the bore 33 and out of the position thereof shown in FIG. 6, the cover 32 closing off the hole 33 automatically by spring force. The magnet 38 can then be removed, and the thread guard or monitor 26 set in operation again. Because of the connection of the magnet 38 with the suction tube 34, it is not possible to leave the thread monitor 26 accidentally blocked when the suction tube 34 is removed from the spinning station.

By shifting and turning the collar 40 on the suction tube 34, the position of the separate thread guide 41 can be changed. This, in turn, has an effect upon the position of the thread reserve on the coil core. The two characteristic positions of the suction tube 34 can be fixed by stops, snap-in detents or the like. The hereinaforedescribed manipulations can, of course, also be performed by a suitable mechanism. For this purpose, for example, a coil exchanging device which travels from spinning station to spinning station and is activated upon demand would be suitable.

Figure 7:
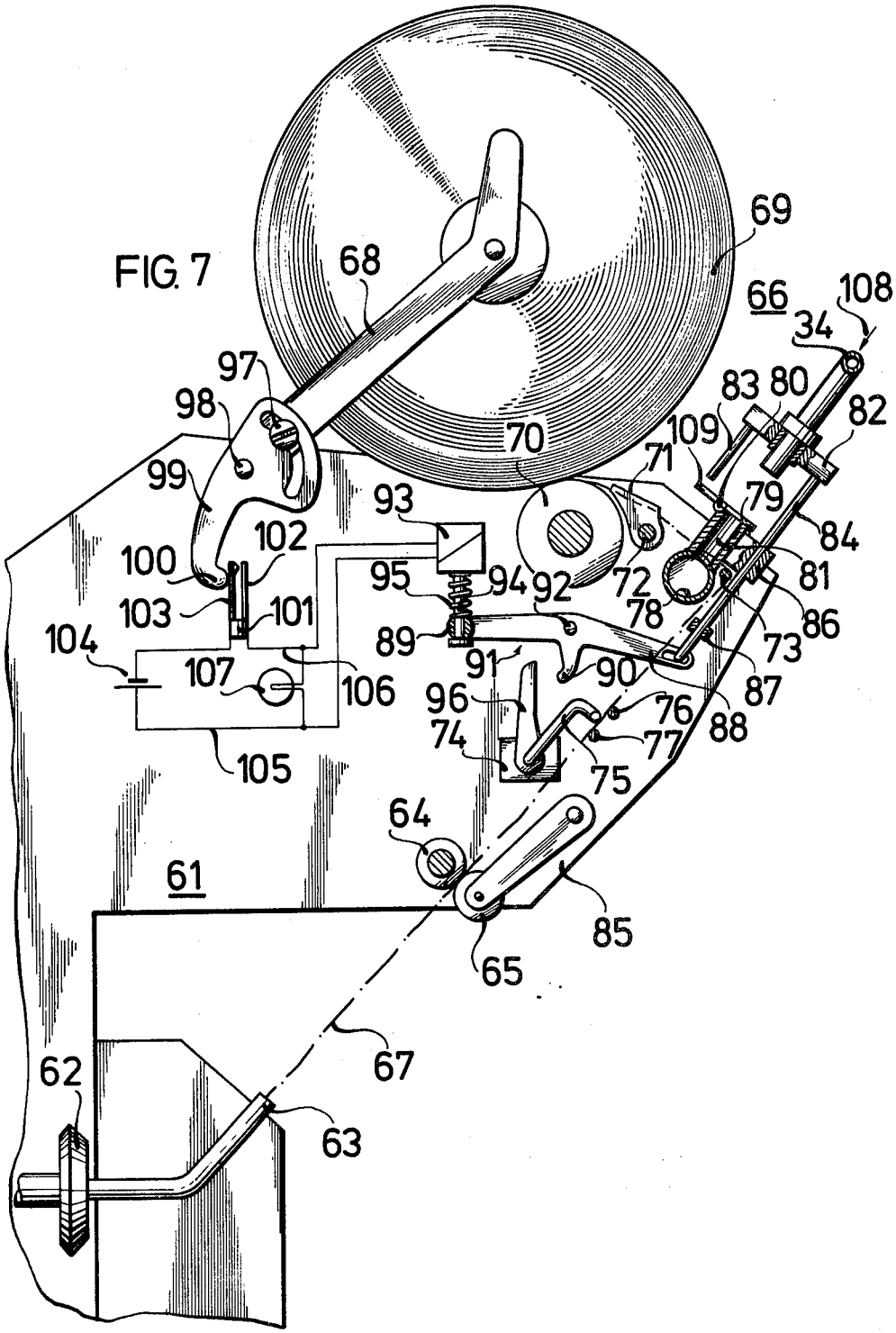
FIG. 7 is a side elevational view of a second embodiment of the device of the invention.

In the second embodiment of the invention according to FIG. 7, there is provided at a spinning station 61, a spinner rotor 62, a withdrawal tube 63, a withdrawal device 64, 65 and a winding device 66. The spun thread 67 is withdrawn at constant velocity and fed to the winding device 66. The winding device 66 has a coil frame 68 with a take-up coil 69 fastened therein. The winding device 66 also includes a winding rollers 70, which rotates continuously and by which the take-up coil 69 is set in rotation by friction. In front of the winding roller 70, a thread guide 71 is provided, which is fastened to a push rod 72. The thread 67 is fed to the thread guide 71 over an equalizing wire 73 like the wire 25 of the first embodiment shown in FIG. 1.

Above the withdrawal device 64, 65, there is provided a thread guard or monitor 74, the follower bar 75 of which engages the thread 67 which is stressed in tension and, in case of an undue reduction in the thread tension, swings forward between two bars 76 and 77, at which the thread guard or monitor 74 transmits a signal to stop the spinning station.

In FIG. 7 there is furthermore shown an underpressure or negative-pressure line 78, which extends along the entire spinning machine and is connected to a non-illustrated underpressure or suction generator, which is like that shown at 30 in FIG. 1. The under-pressure or negative-pressure line 78 has at the spinning station 61, an underpressure or negative-pressure connection point 79 which is constructed as a plug-in coupler that can be closed off automatically by a cover 80. At the plug-in coupler, there is provided a bore 81 which extends into the interior of the under-pressure or negative-pressure line 78.

A suction tube 34 serving as the thread pickup, and which is constructed generally in accordance with that shown in FIG. 2 and which was described in detail hereinabove, is rotatably mounted in a bearing support 82 of each spinning station in the embodiment of FIG. 7. The bearing support 82 is provided with a short rod 83 and a long rod 84. The rod 84 is shiftable longitudinally in slide bearings 86 and 87 which are connected to the machine frame 85 of the winding device 66. The lower end of the rod 84 is articulatingly connected to one end 88 of a three-arm lever 91. The lever 91 is rotatably supported on the machine frame at a pivot point 92.

An electromagnetic drive or actuator 93 mounted on the machine frame 85 has an actuating plunger or armature 94 which is articulatingly connected to the second end 89 of the lever 91. In the rest or neutral condition of the electromagnetic drive 93, a compression spring 95 ensures that the actuating plunger 94 is extended to maximum length and the lever 91 is consequently pivoted counterclockwise, as shown in FIG. 7. In this position of the three-arm lever 91, the third arm or end 90 thereof is lifted from a projection 96 which is connected to the follower bar 75 of the thread guard or monitor 74, simultaneously, the suction tube 34 is drawn out of the underpressure or negative-pressure connecting point 79. The suction tube 34 and the parts connected thereto are therefore out of action and the thread monitor 74 is operative.

At the coil frame 68, there is a two-armed lever or bell crank 99 with a switching projection 100. The lever 99 is adjustable by means of a set screw 97 and is pivotable about a pivot pin 98 fixed to the machine frame 61. A switch 101 with a fixed contact 102 and a movable contact 103 is fastened to the machine frame 85 in vicinity of the switching projection 100. Leads 105 and 106 extend from a voltage source 104 through the switch 101 to a signal lamp 107 to the winding of the electromagnetic drive 93.

The lever 99 is adjusted so that the switching projection 100 thereof closes the switch 101 when the desired coil diameter is reached. This switches on the signal or alarm lamp 107, and current flows through the coil of the electromagnetic drive 93. The actuating plunger 94 is drawn upwardly against the force of the spring 95, the lever 91 is swung clockwise, as shown in FIG. 7, about the pivot pin 92, and the suction tube 34 is moved downwardly in direction of the arrow 108 until the lower end of the suction tube 34 is completely inserted into the bore 81 of the underpressure or negative-pressure connection point 79, which results in the actions intervening in the winding porcess which here explained hereinbefore in connection with the first embodiment of the device shown in FIG. 1, for example. Beforehand, the rod 83 had opened the cover 80, which is provided with a projection 109 for this purpose.

As the lever 91 is pivoted in clockwise direction, as viewed in FIG. 7, the third end 90 thereof approaches to closely to the projection 96 of the follower bar 75, that the follower bar 75 can no longer swing forward between the rods 76 and 77, so that the thread guard or monitor 74 becomes inoperative.

After the severing operation, the thread 67 then runs through the suction tube 34 into the underpressure or negative-pressure line 78 until a coil exchange has been effected either manually or mechanically, for example, by a traveling coil exchanger. During the coil exchange, the suction tube 34 is swung and held down either manually or by the automatic coil exchanging mechanism, as was previously explained and described hereinbefore in connection with the first embodiment of the invention. The transfer of the thread to the new, unwound or empty coil core is thus accomplished automatically. After the winding of a new take-up coil has begun, the suction tube 34 is automatically pulled out of the underpressure or negative-pressure connection point 79 under the biasing action of the compression spring 95 and must then only be swung back by hand or by the automatic coil exchanging mechanism into the starting position thereof. This return swing operation can also be accomplished by a non-illustrated restoring spring. The blocking of the thread guard or monitor 74 is cancelled again, the instant the lever 91 is swung back counterclockwise into the starting position thereof shown in FIG. 7.

As noted hereinbefore, the invention is not limited to the embodiments shown and described. The invention is also suited, for example, to automatization by simple means of the entire process of the take-up coil exchange. The concept of the invention can thus be applied to a traveling coil exchanging device which can connect itself automatically to a suction line and then bring the suction tube with the parts fastened thereto into the range of traverse of the take-up coil to be exchanged, so that the thread is severed and sucked in. Such an exchanging device can subsequently open the coil frame, remove the full take-up coil, take an unwound or empty coil core from a magazine, clamp it in the coil frame, swing the suction tube into the winding position, lower the coil frame with the coil core into the operating position and, after the coil has been started and the thread reserve formed, bring the suction tube back to the starting position thereof. A coil exchanging device which must only be adapted to hold the bent suction tube 34 down for a limited time during the coil exchange and keep it in the coupled position, in the embodiment of FIG. 7, and is otherwise conventional, may be used.

Since, with the use of the invention, the operations (a) severing the thread at the start of the exchange operation, (b) catching or capturing the thread when starting the winding, (c) severing the thread end after the winding has started, and (d) laying lown the reserve turns, are initiated and executed automatically in correct sequence by merely bringing the suction tube into the range of traverse, by the movement of the thread pickup in conjunction with direction changes of the run or course of the thread necessarily resulting therefrom, and by increases of the thread tension, no special control means are required for controlling the individual operations no matter whether the coil exchange is made by hand or by an automatic exchanging mechanism.

There are claimed:

1. Device for transferring to an empty coil core a thread continuously fed to the take-up coil of a rotor spinning machine, comprising a thread guide traversible along a reciprocating path between the ends of a coil core for guiding a thread onto the coil core, a thread pickup assembly having means for picking up the thread under tension before transfer thereof to an empty coil core, said thread pickup assembly being pivotable from a first location on said reciprocating path to a second location at one of the ends of the coil core, said thread pickup assembly comprising a thread capturing device as well as a pair of thread severing devices respectively disposed in front of and behind said pickup means in travel direction of the thread, said thread severing devices being activatable in time sequence by movement of said thread pickup assembly so that in said first location thereof said thread severing device disposed behind said pickup means is activatable, after capture of the thread by said capturing device, in time coordination with the pickup of the thread, and at said second location of said thread pickup assembly said thread severing device disposed in front of said pickup means is activatable at an instant within the period during and shortly after transfer of the thread to the empty coil core.

2. Device according to claim 1 wherein said thread severing devices are formed of stationary, uncontrolled knives having thread guidance contours associated therewith, and said thread pickup means comprises a suction tube formed with a thread suction opening.

3. Device according to claim 2 including a separate thread guide disposed on said thread pickup assembly so as to guide the thread automatically into vicinity of the coil core during a pivoting movement of said thread pickup assembly.

4. Device according to claim 3 wherein, for forming a thread reserve on the coil core, said separate thread guide is disposed so that it is located outside the traversible reciprocating path of a takeup coil that is to be newly wound, the instant said thread pickup has completed the pivoting movement thereof in direction toward one of the ends of the coil core.

5. Device according to claim 1 including a thread monitor activatable in response to absence of the thread for effecting shutdown of the machine, and means connected to said thread pickup for temporarily inactivating said thread monitor.

6. Device according to claim 1 including a thread monitor activatable in response to absence of the thread for effecting shutdown of the machine, and a device responsive to the fullness of winding on the takeup coil for automatically delivering said thread pickup means into vicinity of said traversible reciprocating path of the thread fed to the takeup coil and for temporarily inactivating said thread monitor.

7. Device according to claim 6 wherein said device responsive to the fullness of winding on the takeup coil has an electromagnetic drive operatively connected to said thread pickup means and to said thread monitor, said electromagnetic drive having a winding, and including switch means responsive to fullness of winding on the takeup coil, said switch means connecting said winding of said electromagnetic drive to a voltage source.

* * * * *